US009913565B2

(12) United States Patent
Smith et al.

(10) Patent No.: US 9,913,565 B2
(45) Date of Patent: Mar. 13, 2018

(54) SQUEEGEE DEVICES WITH ONE OR MORE COLLECTION FEATURES

(71) Applicant: Unger Marketing International, LLC, Bridgeport, CT (US)

(72) Inventors: Robert F. Smith, Waterbury, CT (US); James M. Buckley, New Hartford, CT (US); Paul Adams, Monroe, CT (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 238 days.

(21) Appl. No.: 14/508,811

(22) Filed: Oct. 7, 2014

(65) Prior Publication Data

US 2016/0095492 A1 Apr. 7, 2016

(51) Int. Cl.
*A47L 13/11* (2006.01)

(52) U.S. Cl.
CPC ..... *A47L 13/11* (2013.01)

(58) Field of Classification Search
CPC ..... A47L 1/06; A47L 1/08; A47L 13/11
See application file for complete search history.

(56) References Cited

U.S. PATENT DOCUMENTS

| | | | |
|---|---|---|---|
| 1,497,933 | A | 6/1924 | Oberti |
| 1,500,274 | A | 7/1924 | Scarling |
| 1,720,630 | A | 11/1925 | Eiermann |
| 1,918,611 | A | 7/1933 | Oberti |
| 1,964,134 | A | 6/1934 | Oberti |
| 2,043,775 | A | 6/1936 | Rosen |
| 2,088,777 | A | 8/1937 | Dennis |
| 2,123,638 | A | 7/1938 | Ettore |
| 2,197,927 | A | 4/1940 | Ehrlich |
| 2,225,432 | A | 12/1940 | Ginsberg |
| 2,230,489 | A | 2/1941 | Grossfeld |
| 2,261,475 | A | 11/1941 | Kautenberg |
| D173,462 | S | 11/1954 | Schmoller |
| 2,905,959 | A | 9/1959 | Ferreira |
| 2,914,787 | A | 12/1959 | Hartkoff |
| D222,703 | S | 12/1971 | Richardson |

(Continued)

FOREIGN PATENT DOCUMENTS

| | | | |
|---|---|---|---|
| DE | 102007027124 | A1 | 10/2008 |
| FR | 2691348 | A3 | 12/1993 |

(Continued)

OTHER PUBLICATIONS

International Search Report dated Jan. 8, 2016 for corresponding PCT/US15/54546, 3 pages.

(Continued)

*Primary Examiner* — Randall Chin
(74) *Attorney, Agent, or Firm* — Ohlandt, Greeley, Ruggiero & Perle, L.L.P.

(57) ABSTRACT

A squeegee device is provided that includes a blade support and a deflector. The blade support has a front support and a rear support, which are configured to secure a squeegee blade therebetween. The deflector has a lower portion and an upper portion, which are configured so that the lower portion of the deflector depends upward from the blade support and a leading edge of the upper portion is forward, with respect to a pushing direction, from the blade support.

19 Claims, 13 Drawing Sheets

(56) References Cited

U.S. PATENT DOCUMENTS

| | | | | |
|---|---|---|---|---|
| 3,766,591 | A * | 10/1973 | Soito | A47L 13/11 15/244.1 |
| 3,787,921 | A | 1/1974 | Feldmann | |
| D285,736 | S | 9/1986 | Seely | |
| 4,697,296 | A | 10/1987 | Smahlik | |
| 4,777,694 | A | 10/1988 | Young | |
| 5,117,530 | A | 6/1992 | Rank | |
| 5,347,676 | A | 9/1994 | Saitoh | |
| 5,349,716 | A * | 9/1994 | Millar | A47L 13/11 15/236.06 |
| D355,075 | S | 2/1995 | Stone | |
| D367,344 | S | 2/1996 | Kruse | |
| D368,344 | S | 3/1996 | Hansen | |
| 5,528,793 | A | 6/1996 | Schbot | |
| D388,569 | S | 12/1997 | Israel | |
| 6,092,255 | A | 7/2000 | Kim | |
| 6,243,911 | B1 | 6/2001 | Varner | |
| D447,301 | S | 8/2001 | Adair | |
| D464,182 | S | 10/2002 | Vosbikian | |
| D473,028 | S | 4/2003 | Hay | |
| 6,668,418 | B2 | 12/2003 | Bastien | |
| D515,262 | S | 2/2006 | Hay | |
| D539,496 | S | 3/2007 | Sickler et al. | |
| 7,185,388 | B2 | 3/2007 | Sander | |
| D585,616 | S | 1/2009 | Libman | |
| D603,116 | S | 10/2009 | Antoniello | |
| 7,654,591 | B2 | 2/2010 | Marble | |
| D685,547 | S | 7/2013 | Vasilakes | |
| D704,911 | S | 5/2015 | Albo | |
| 2003/0044220 | A1 | 3/2003 | Vito | |
| 2005/0193516 | A1 | 9/2005 | Hughes | |
| 2006/0222438 | A1 * | 10/2006 | Alexander | A47L 13/11 401/48 |
| 2007/0020039 | A1 | 1/2007 | DeMuth et al. | |
| 2014/0123425 | A1 | 5/2014 | Harper et al. | |
| 2016/0095492 | A1 | 4/2016 | Smith et al. | |

FOREIGN PATENT DOCUMENTS

| | | |
|---|---|---|
| FR | 015212001 | 2/2002 |
| GB | 1058666 | 10/1989 |
| GB | 3009481 | 3/2003 |

OTHER PUBLICATIONS

Written Opinion of the International Searching Authority dated Jan. 8, 2016 for corresponding PCT/US15/54546, 5 pages.

Amazon.com: Ettore 17008 All-Purpose Squeegee, online, review date Oct. 30, 2013.

Amazon.com: Ettore 11112 Rust Proof Aluminum Squeegee, online, review date Jul. 10, 2013.

Amazon.com: Cleret iDO 2 Shower Squeegee, online, review date Jan. 24, 2014.

* cited by examiner

SQUEEGEE DEVICES WITH ONE OR MORE COLLECTION FEATURES

BACKGROUND

1. Field of the Disclosure

The present disclosure is related to squeegeed devices. More particularly, the present disclosure is related to squeegee devices with one or more collection features that provide improved pushing efficiency.

2. Description of Related Art

Squeegee devices are known in the art. Such devices include a handle secured to a rubber squeegee blade. Many devices have been developed for use with floors or large flat surfaces. Here, the handle is then used in a known manner to move the blade along a floor, driveway, walkway, or any other substantially flat surface to push liquid and/or solid debris to a desired location.

Unfortunately, many prior art squeegee devices fail to collect all of the debris. For example, many prior art squeegee devices let the debris flow over and/or around the squeegee blade.

Accordingly, it has been determined by the present disclosure that there is a need for squeegee devices that provide an improved or increased ability to push or collect debris.

SUMMARY

A squeegee device is provided that includes one or more collection features selected from the group consisting of a deflector, a concave curvature, and combinations thereof.

A squeegee device is provided that includes a blade support and a deflector. The blade support has a front support and a rear support, which are configured to secure a squeegee blade therebetween. The deflector has a lower portion and an upper portion, which are configured so that the lower portion of the deflector depends upward from the blade support and a leading edge of the upper portion is forward, with respect to a pushing direction, from the blade support.

In some embodiments, deflector and the blade support have a concave curve with respect to the pushing direction. The concave curvature can be constant across a length of the deflector and the blade support and/or can provide the deflector with a rise-to-run ratio of between 1:6 and 1:24.

In some embodiments alone or in combination with one or more of the aforementioned or below mentioned embodiments, the deflector is configured so that the leading edge is parallel to or downwardly curved from a horizontal plane that is tangent to an uppermost portion of the deflector.

In some embodiments alone or in combination with one or more of the aforementioned or below mentioned embodiments, the upper portion of the deflector is configured as a curved portion that circumscribes between 85 and 115 degrees.

In other embodiments alone or in combination with one or more of the aforementioned or below mentioned embodiments, the deflector has a ratio of deflector height to blade height of between 2:1 and 1:2.

In other embodiments alone or in combination with one or more of the aforementioned or below mentioned embodiments, at least one of the front support and the rear support are formed as a one-piece unit with the lower portion of the deflector.

In other embodiments alone or in combination with one or more of the aforementioned or below mentioned embodiments, the front support is formed as a one-piece unit with the lower portion of the deflector. Here, the device can further include a bridge between the rear support and the lower portion of the deflector so that the lower portion is offset, in the pushing direction, from the rear support. In some embodiments, the rear support is formed as a one-piece unit with the bridge.

In other embodiments alone or in combination with one or more of the aforementioned or below mentioned embodiments, the device further includes a handle receiver securing a handle to the blade support. In some embodiments, the device further includes a bridge between the rear support and the lower portion of the deflector so that the lower portion is offset, in the pushing direction, from the rear support, wherein the handle receiver is supported by both the rear support and to the bridge.

In other embodiments alone or in combination with one or more of the aforementioned or below mentioned embodiments, the device further includes the squeegee blade secured in the blade support. In some embodiments, the blade support is extruded and further includes one or more first retainers formed in the front and/or rear supports configured to secure the blade in the blade support, the one or more first retainers running in an extrusion direction of the blade support. In further embodiments, the device includes a capture member between the squeegee blade and the blade support. When present, the capture member includes a plurality of second retainers that correspond in number and location to the plurality of first retainers.

A squeegee device is also provided that includes a blade support, a deflector, and a bridge. The blade support has a front support and a rear support, which are configured to secure a squeegee blade therebetween. The deflector has a leading edge that depends upward from and forward, with respect to a pushing direction, from the blade support. The bridge connected to one of the front and rear supports above the squeegee blade.

In other embodiments alone or in combination with one or more of the aforementioned or below mentioned embodiments, the deflector, the blade support, and the bridge have a concave curve with respect to the pushing direction.

In other embodiments alone or in combination with one or more of the aforementioned or below mentioned embodiments, the deflector is configured so that a leading edge of the deflector is parallel to or downwardly curved from a horizontal plane that is tangent to an uppermost portion of the deflector.

In other embodiments alone or in combination with one or more of the aforementioned or below mentioned embodiments, at least one of the front support and the rear support are formed as a one-piece unit with the deflector and the bridge.

The above-described and other features and advantages of the present disclosure will be appreciated and understood by those skilled in the art from the following detailed description, drawings, and appended claims.

DETAILED DESCRIPTION

Figure 1:
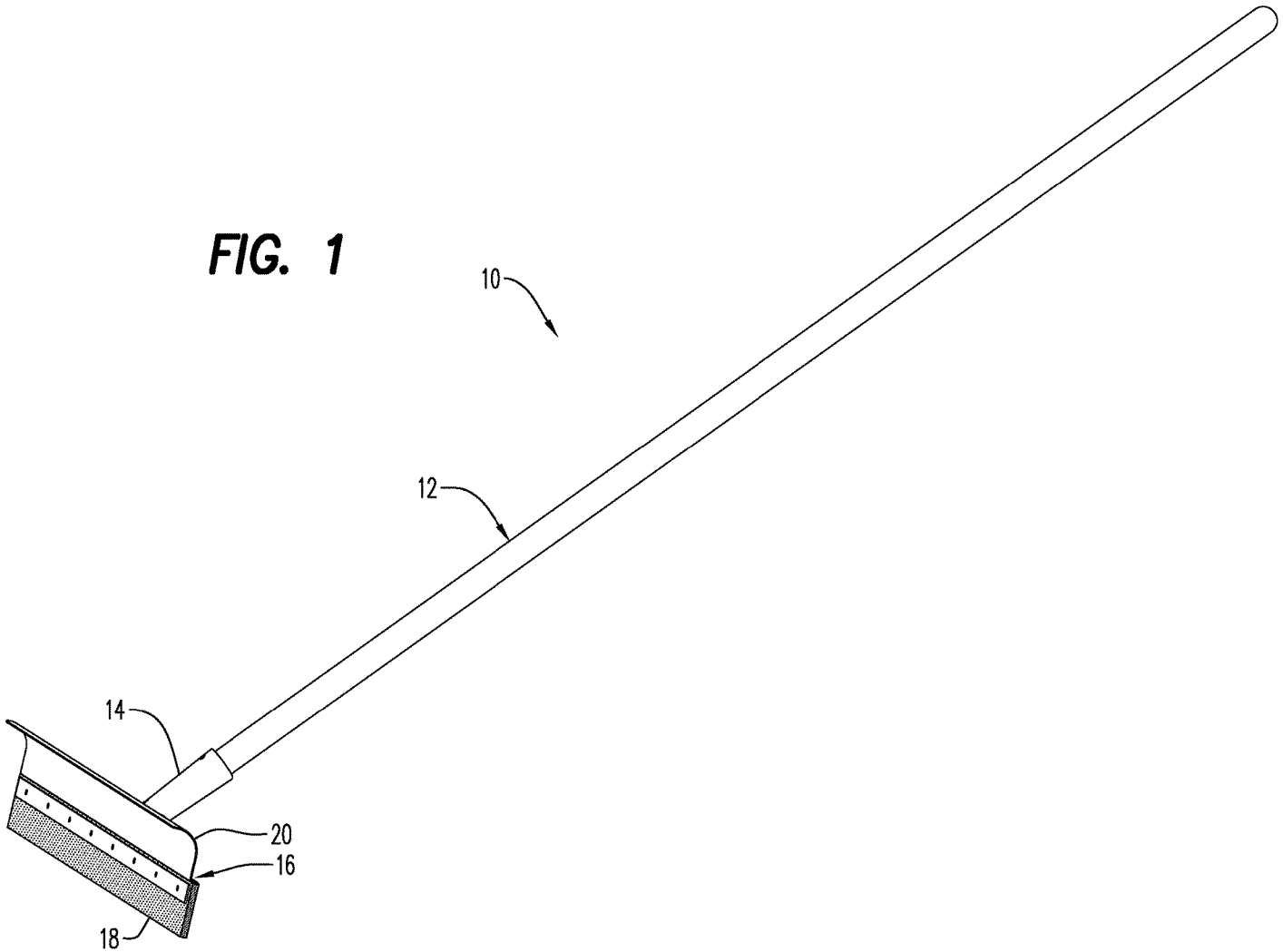
FIG. 1 is a front perspective view of an exemplary embodiment of a squeegee device according to the present disclosure.
Figure 2:
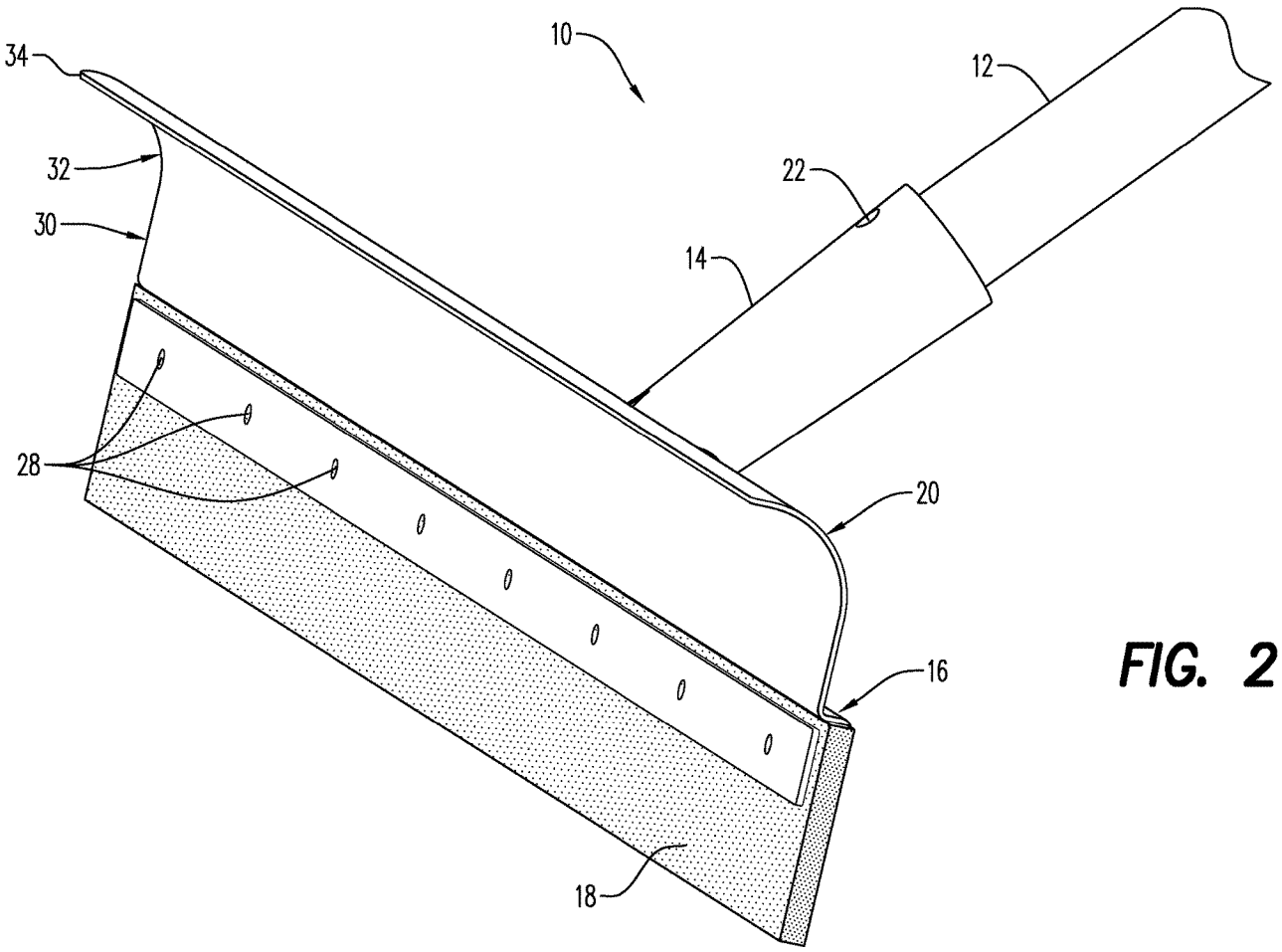
FIG. 2 is a magnified front perspective view of the device of FIG. 1.
Figure 3:
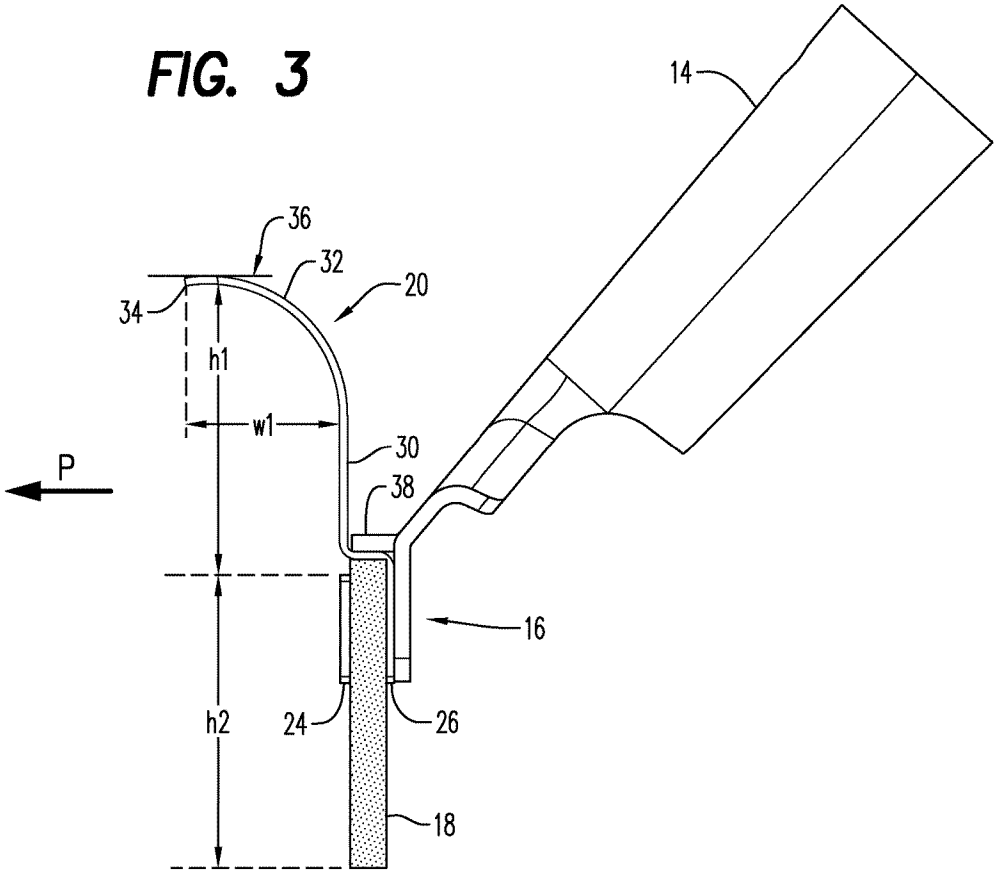
FIG. 3 is a side view of the device of FIG. 2.
Figure 4:
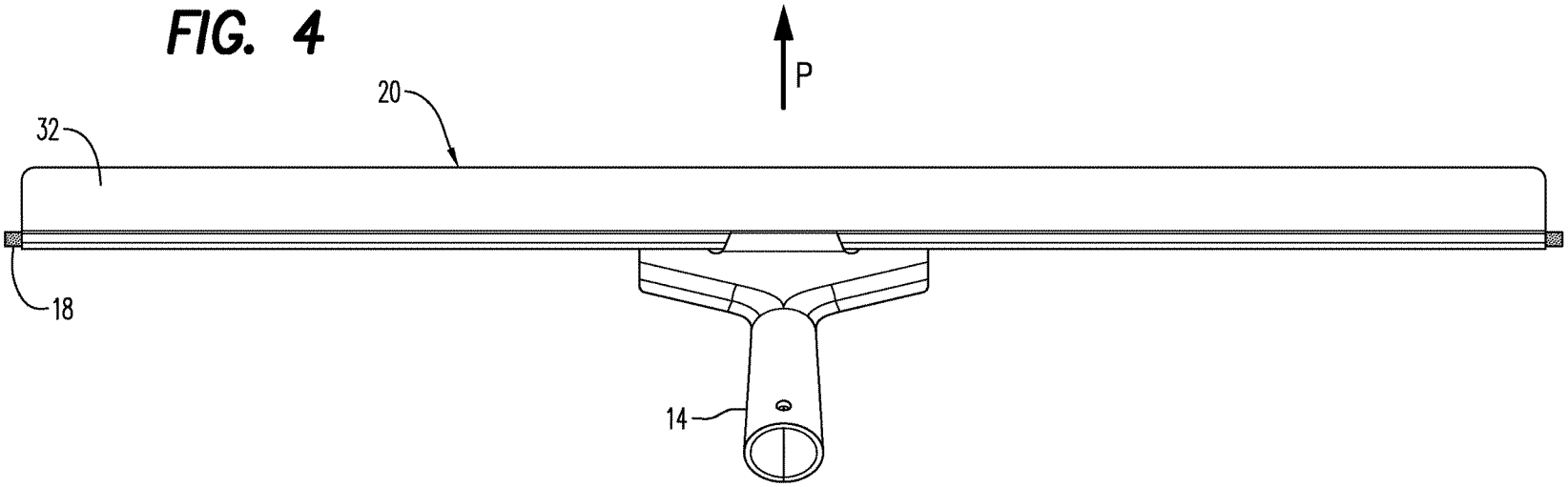
FIG. 4 is a top view of the device of FIG. 2.
Figure 5:
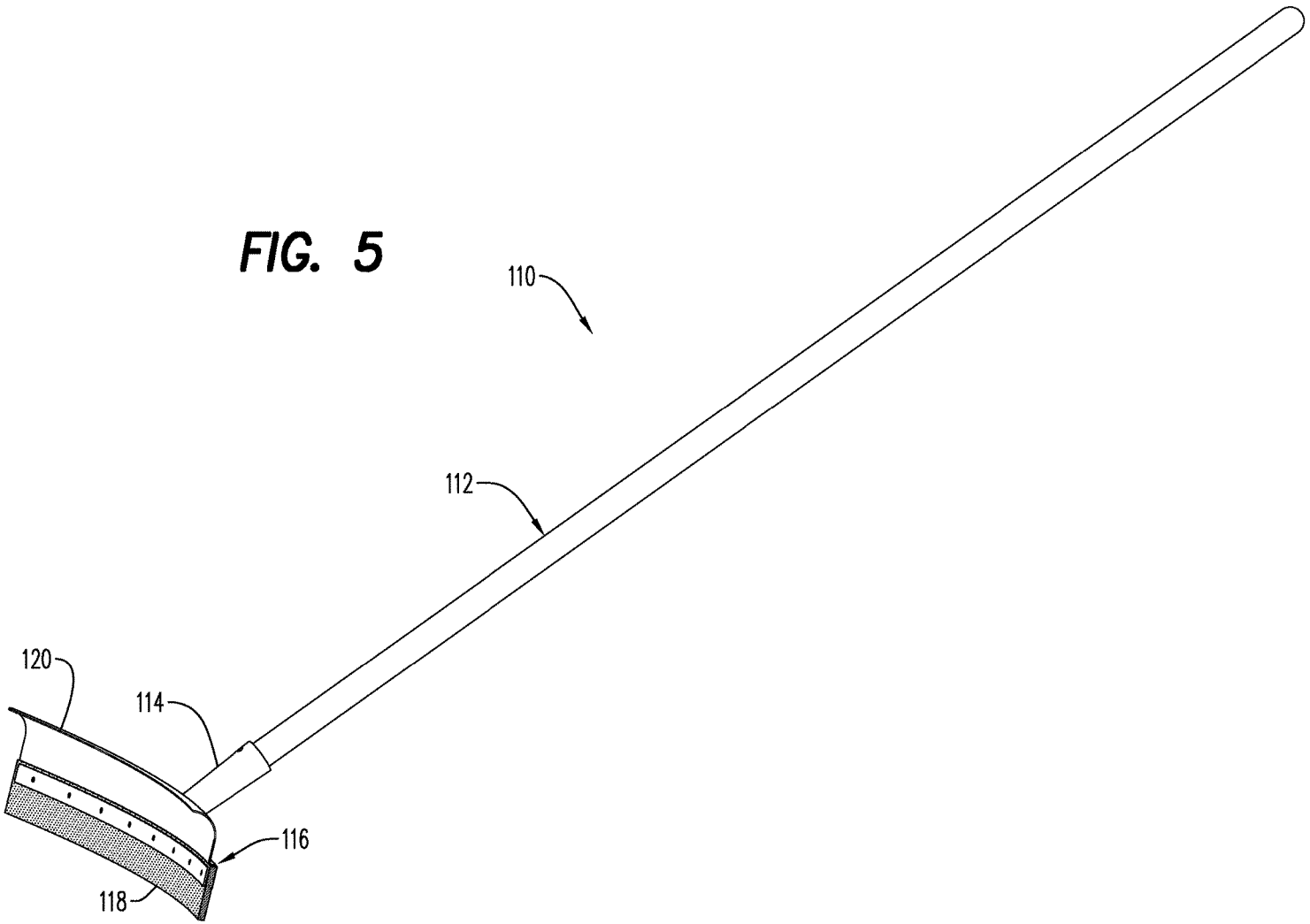
FIG. 5 is a front perspective view of an alternate embodiment of a squeegee device according to the present disclosure.
Figure 6:
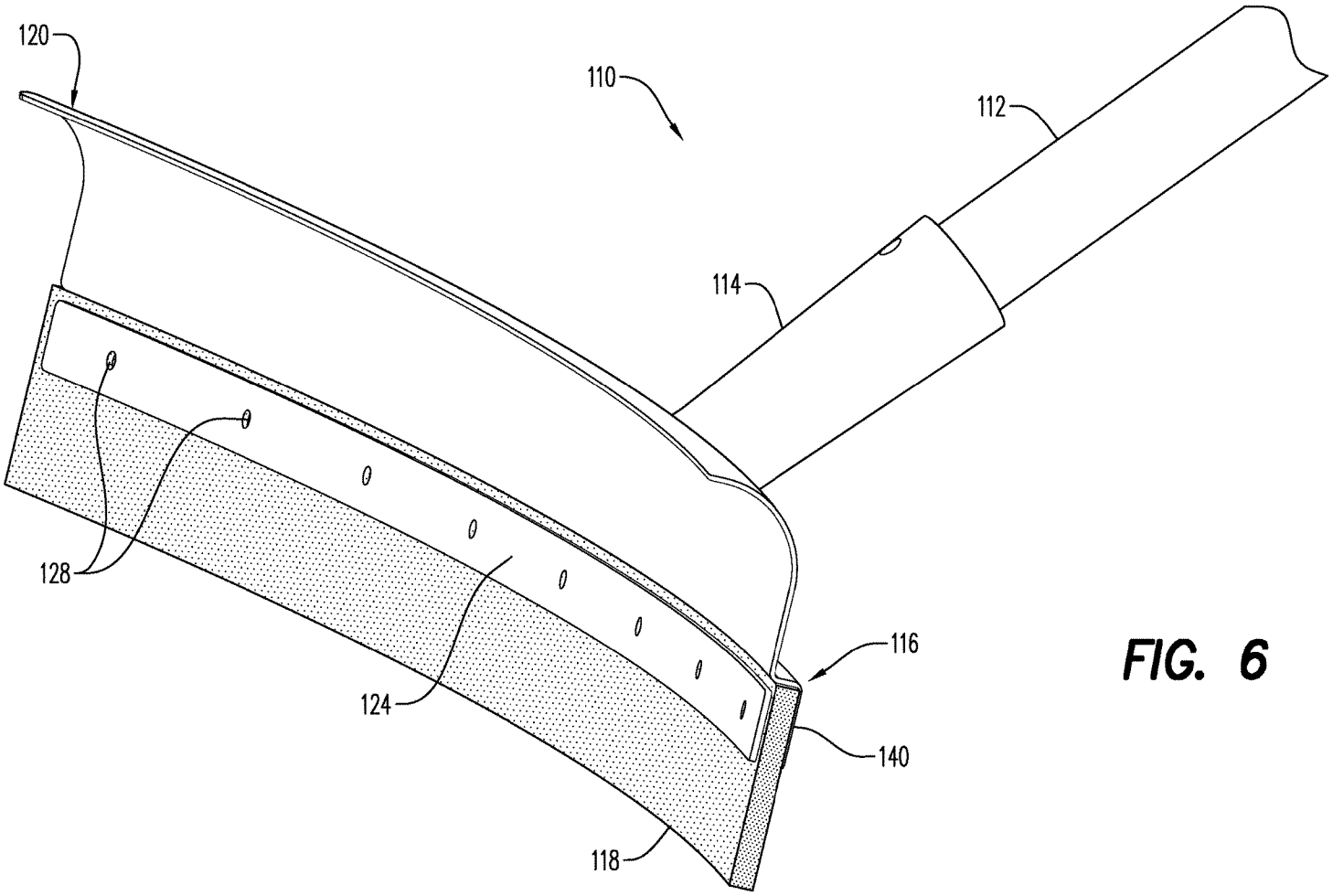
FIG. 6 is a magnified front perspective view of the device of FIG. 5.

Referring to the drawings and in particular to FIGS. 1-4, a squeegee device according to the present disclosure is shown and is generally referred to by numeral 10. Advantageously, device 10 is configured with one or more collection features that prevent or at least mitigate debris from flowing over and/or around the squeegee during use. In this manner, device 10 provides improved pushing efficiency as compared to prior art squeegee devices.

As used herein, the term "debris" can mean any liquid material, any solid material, and any mixture of solid and liquid materials. In this manner, device 10 is configured for use in pushing debris such as, but not limited, to water, snow, slush, ice, dirt, dust, rocks, metal shavings, other debris, and any combinations thereof.

For ease of understanding, device 10 is discussed herein as particularly configured for use as a floor squeegee device. Of course, it is contemplated by the present disclosure for the attributes of device 10 to find equal use when configured to remove debris from surfaces other than floors.

Device 10 includes a handle 12, a handle receiver 14, a blade support 16, a squeegee blade 18, and a deflector 20. Deflector 20 functions as a debris collection feature that prevents or at least mitigates debris from flowing over and/or around support 16 and/or blade 18 during use.

Handle 12 can have any desired thickness and length. Moreover, handle 12 can have any desired construction. For example, handle 12 can be a one piece handle such as that illustrated in FIGS. 1-4. Alternately, handle 12 can be any multi-piece handle that can be adjusted in length as needed. Handle 12 can be made of any desired material such as but not limited to wood, steel, aluminum, carbon fiber, plastic, other materials, and any combinations thereof.

Handle receiver 14 is configured to secure handle 12 directly and/or indirectly to blade support 16. Receiver 14 can permanently secure handle 12 to blade support 16 or can releasably secure the handle and support to one another. In the illustrated embodiment, handle 12 is shown as a wooden handle and receiver 14 is shown having a screw 22 that releasably secures the handle to the receiver. Of course, it is contemplated by the present disclosure for receiver 14 to have any desired construction.

Blade support 16 includes a front support 24 and a rear support 26, and, in some embodiments, a plurality of fastener openings 28 that receive fasteners (not shown) to secure blade 18 in the blade support. During assembly, blade 18 is placed between front and rear supports 24, 26, which are secured to one another by the fasteners within the openings 28. In this manner, blade 18 is maintained in a desired position in support 16. In some embodiments, the fastener openings 28 are configured to allow the fasteners to pass through blade 18 to further assist in securing blade 18 in the desired position in support 16. The fasteners can include screws, bolts and nuts, bolts and threaded openings, rivets, snap fit fasteners, and others. It is contemplated by the present disclosure for blade 18 to be permanently or releasably secured in blade support 16 by, for example, the fasteners in openings 28 or any desired method.

Handle receiver 14 and blade support 16 can be secured to one another in any desired manner such as, but not limited to, mechanical fasteners, adhesive fasteners, thermal fastening, and combinations thereof. In some embodiments, at least some of openings 28 that secure front and rear supports 24, 26 to one another can further be configured to allow the fasteners to also secure handle receiver 14 to blade support 16. In other embodiments, handle receiver 14 is secured to blade support 16 by one or more spot welds (not shown).

Blade 18 can be made of any resilient and/or flexible material. Preferably, blade 18 is made of natural or synthetic rubber. Of course, it is contemplated by the present disclosure for blade to be made of other materials such as, but not limited to, polyurethane, styrene-butadiene rubber (SBR), foam, closed-cell foam rubber, ethylene propylene diene monomer rubber (EPDM), polyvinyl chloride (PVC), and others.

Deflector 20 includes a first or lower portion 30 and a second or upper portion 32 so that the deflector depends upward from blade support 16 and forward, with respect to a pushing direction P, from the blade support.

Upper portion 32 can be configured so that a leading edge 34 of deflector 20 is parallel to or downwardly curved from a horizontal plane 36 that is tangent to an uppermost portion of deflector 20. Stated another way, deflector 20 is curved configured so that upper portion 32 circumscribes about ¼ of a circle, namely between 70 and 125 degrees, preferably between 85 and 115 degrees, with between 90 and 110 degrees being most preferred, and any sub-ranges therebetween.

Device 10 can be configured to have a ratio of deflector height (h1) to blade height (h2) of between 3:1 and 1:3, with between 2:1 and 1:2 being preferred, with between 1.5:1 and 1:1.5 being more preferred, and with 1:1.2 being most preferred. Deflector height (h1) is a combination of the heights of lower and upper portions 30, 32, while blade height (h2) is a height of blade 18. In the preferred embodiment, lower portion 30 is a substantially planar or vertical portion, while upper portion 32 is a curved or radiused portion.

Device 10 can also be configured to have a ratio of blade height (h2) to deflector width (w1) of between 4:1 and 1:4, with between 3:1 and 1:3 being preferred, with between 2:1 and 1:2 being more preferred, and with 1:1 being most preferred. Deflector width (w1) is a combination of the distance of lower and upper portions 30, 32 in the pushing direction (P).

Advantageously and without wishing to be bound by any particular theory, it has been determined by the present disclosure that the combination of the circumferential span of deflector and the deflector-to-blade height ratio provides improved pushing efficiency as compared to prior art squeegee devices by mitigating flow over blade support.

Device 10—particularly rear support 26 and deflector 20—are preferably formed as a one-piece unit, preferably through a stamping process. In this manner, device 10 can be easily and inexpensively formed. In other embodiments, device 10—particularly rear support 26 and deflector 20—can be cast or molded using metals, plastics and other materials.

In some embodiments, device 10 further includes a bridge 38 between rear support 26 and lower portion 30 of deflector 20. Bridge 38 is preferably configured to offset, in the pushing direction P, lower portion 30 from rear support 26. Handle receiver 14 can be secured to or supported by both rear support 26 and to bridge 38, which has been found to provide additional support and structure to the interconnection of blade support 16 and handle receiver 14.

Referring now to FIGS. 5-8, an alternate embodiment of squeegee device 110 according to the present disclosure is shown. Device 110 includes a handle 112, a handle receiver 114, a blade support 116, a squeegee blade 118, and a deflector 120. For reasons of brevity and clarity, only the features of device 110 that differ from that discussed above with respect to device 10 are described herein below.

In this embodiment, blade support 116 and deflector 120 have a concave curvature in the pushing direction P. Since blade 118 is resilient and/or flexible, the blade is held in the curved position by support 116. Deflector 120 again functions as a debris collection feature, as does the concave curvature, which work together to prevent or at least mitigate debris from flowing over and/or around blade support 116 and blade 118 during use.

Thus, device 110 includes both deflector 120 that includes the circumferential span and deflector-to-blade height ratio disclosed above with respect to device 10, and further includes concave curvature, which, without wishing to be bound by any particular theory, are believed to further combine to provide improved pushing efficiency as compared to prior art squeegee devices by mitigating flow over blade support.

Figure 7:
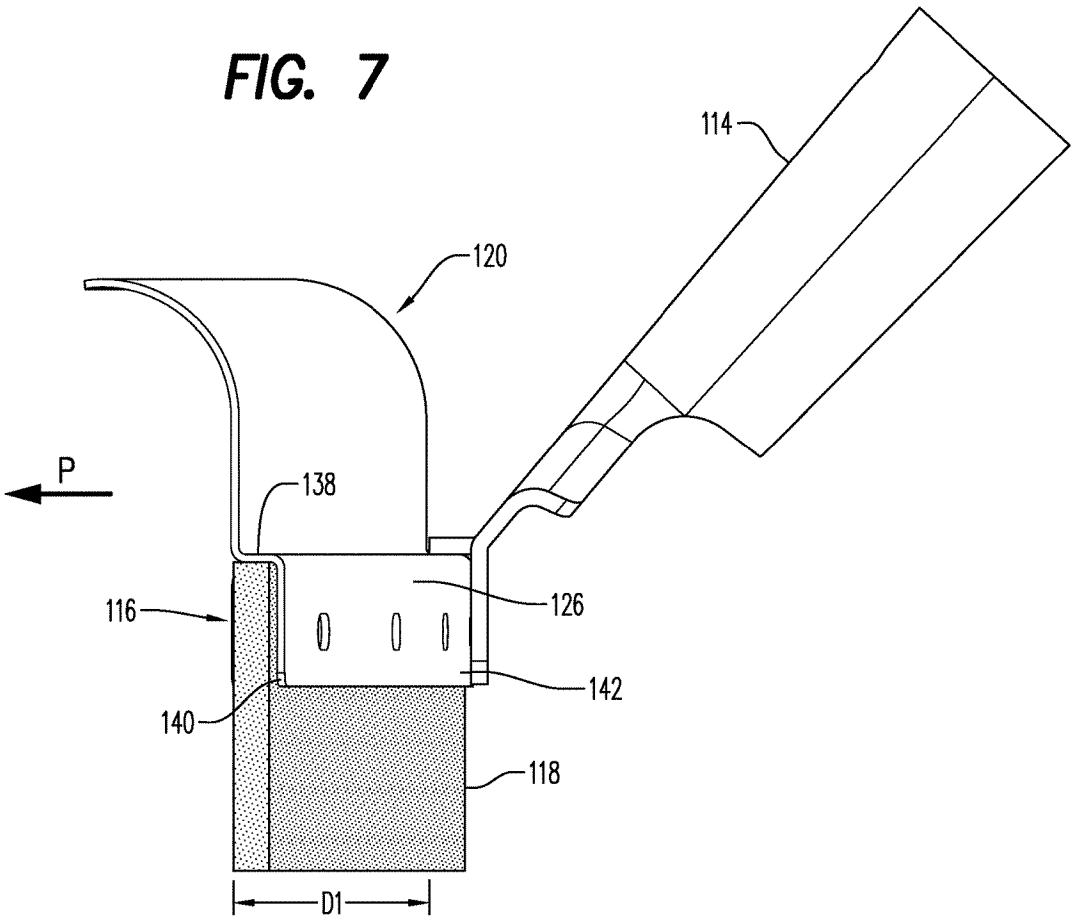
FIG. 7 is a side view of the device of FIG. 6.
Figure 8:
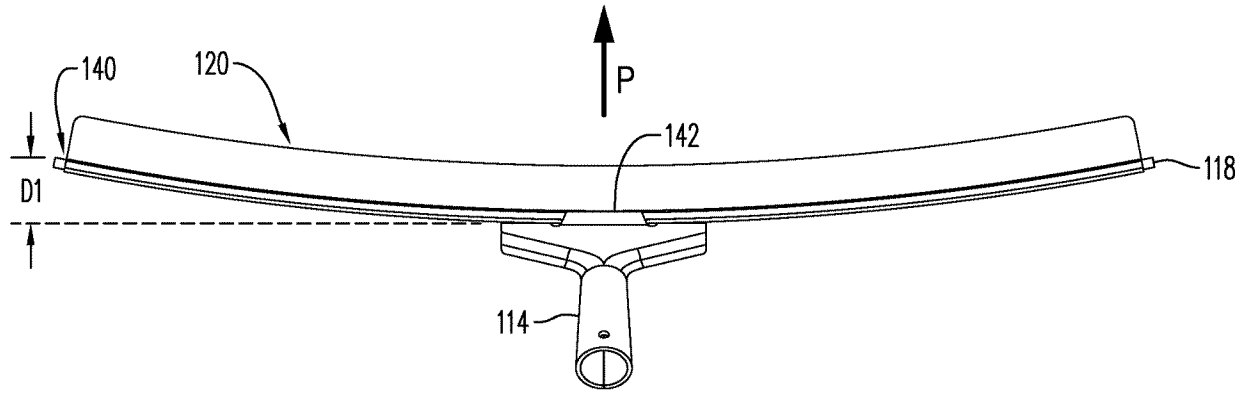
FIG. 8 is a top view of the device of FIG. 6.

The concave curvature of blade support 116 and deflector 120 is best seen in FIGS. 7 and 8, which is configured so that the leading edge of rear support 126 at its tips 140 is forward, with respect to the pushing direction P, of the leading edge of the rear support at its central region 142. In this manner, tips 140 of rear support 126 are forward of central region 142 by a predetermined dimension (D1) and, hence, the tips of blade 118 are forward of the central region of the blade.

Dimension D1 can be any desired dimension depending on, among other factors, the length of blade support 116, the stiffness of blade 118, and the intended debris that device 110 is designed for use with.

By way of example, in embodiments where blade support 116 has an overall length (from tip-to-tip) of 24 inches such as that shown in FIG. 8, dimension D1 can be between 0.25 and 3 inches, with between 0.5 and 2 inches being preferred, with 1.2 inches being most preferred, and any sub-ranges therebetween.

The curvature of blade support 116 can also be described as a ratio of the rise of the blade support to the run of the blade support. Specifically, where blade support 116 has an overall length of 24 inches that is measured from tip 140 to tip 140, then the blade support has a "run" that is measured from the central region 142 to the tip 140 of 12 inches—namely one half of the overall length. In the example where the dimension D1 (e.g., the rise) is 1.2 inches and the overall length is 24 inches providing a run of 12 inches, blade support 116 has a ratio of rise-to-run of 1:10. However, this example ratio of rise-to-run is only exemplary with ratios of between 1:4 to 1:48 being preferred, with ratios of between 1:6 to 1:24 being more preferred, and a ratio of 1:10 being most preferred.

The curvature is shown by way of example in the embodiments of FIGS. 5-8 as being constant across the length of blade support. Thus, looking at dimension D1 another way, in embodiments where blade support 116 has a length of 24 inches, the blade support has a radius of curvature of between 25 and 300 inches, with between 40 and 150 inches being preferred, with about 60 inches being most preferred, and any sub-ranges therebetween.

Of course, it is contemplated by the present disclosure for device 110 to have any desired curvature such that the leading edge of rear support 126 at its tips 140 is forward, with respect to the pushing direction P, of the leading edge of the rear support at its central region 142. Thus, it is contemplated by the present disclosure for only the outer regions of blade support 116 to be curved or bent, while the central area is straight.

Figure 9:
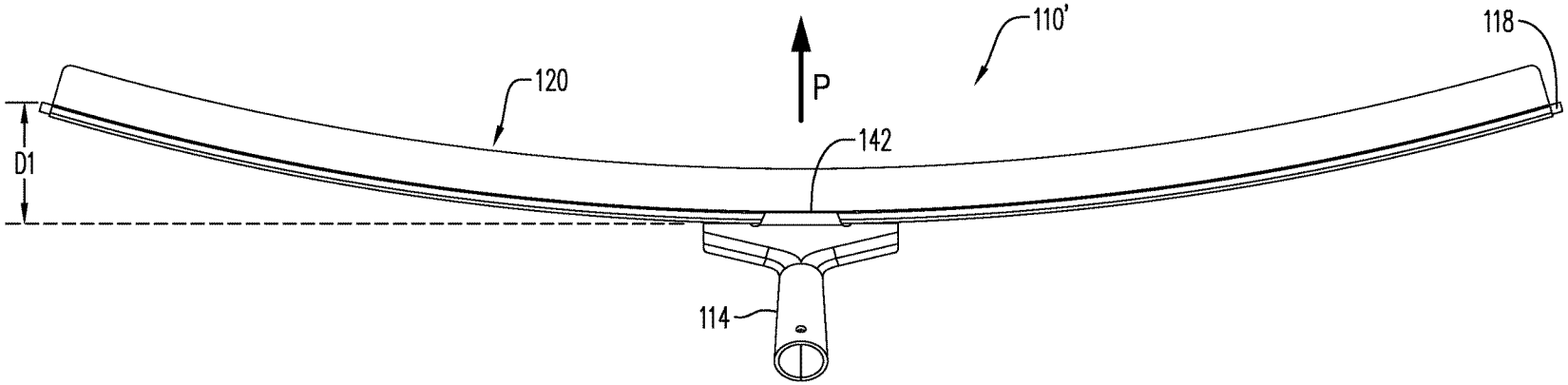
FIG. 9 is a top view of an alternate embodiment of the device of FIG. 8.

For reasons of clarity, device 110 is shown in FIGS. 5-8 having a first blade length and another embodiment of device 110' is shown in FIG. 9 having a second, longer blade length.

Again, devices 110, 110'—particularly rear support 126 and deflector 120 and, when present bridge 138—are formed as a one-piece unit that is stamped. It has been found that after forming the one-piece deflector 120, rear support 126, and bridge 138, the workpiece and be subjected to a second stamping or other bending operation to provide the concave curvature. Preferably, devices 110, 110' can be formed in a single stamping operation that simultaneously forms the one-piece deflector 120, rear support 126, and bridge 138, and the concave curvature. Similarly, the separately formed front support 124 can, after forming, be subjected to one or multiple stamping and/or bending and/or rolling operations to provide the concave curvature.

The embodiments of FIGS. 1-9 are shown as stampings, with rear support 26, 126 of blade support 16, 116 being a one-piece stamped unit with bridge 38, 138, and deflector 20, 120. Of course, it is contemplated by the present disclosure for the squeegee device to be formed of a drawn or extruded member or cast or molded member of metal, plastic, or other suitable material.

Exemplary embodiments of squeegee devices 210, 210' having drawn or extruded members are shown in FIGS. 10-13. Again and for reasons of brevity and clarity, only the features of devices 210, 210' that differ from those discussed above with respect to devices 10, 110, 110' are described herein below.

Figure 10:
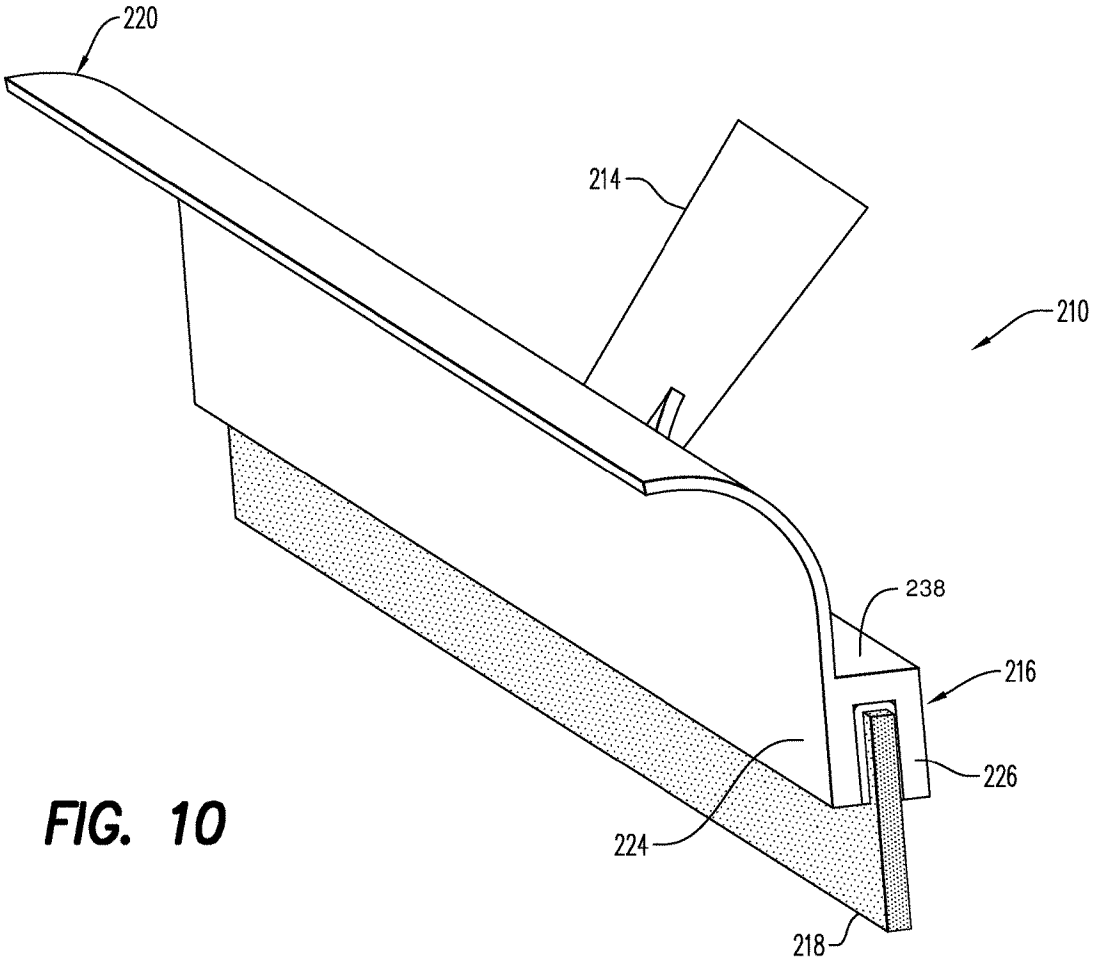
FIG. 10 is a magnified front perspective view of another alternate embodiment of a squeegee device according to the present disclosure.
Figure 11:
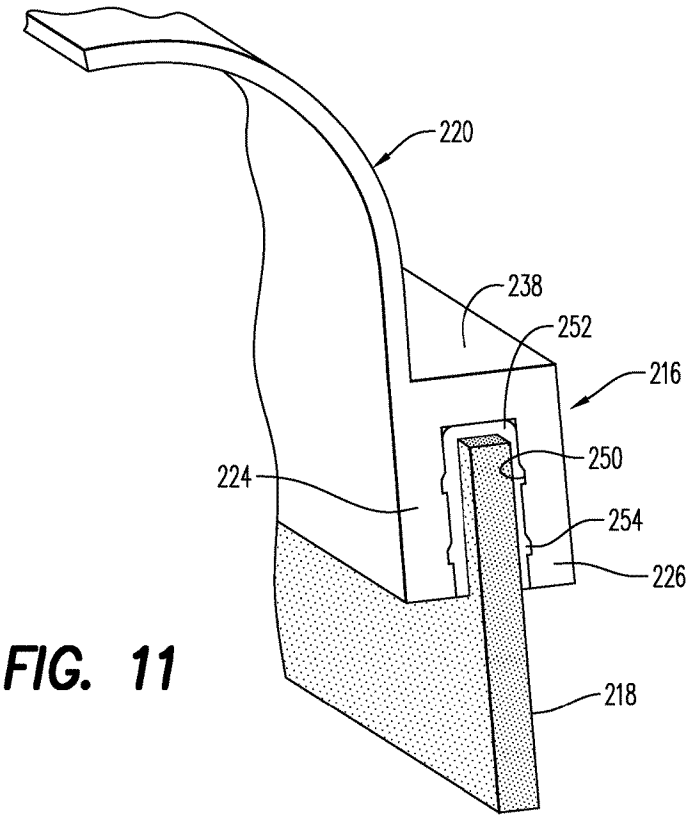
FIG. 11 is a magnified view of the device of FIG. 10.
Figure 12:
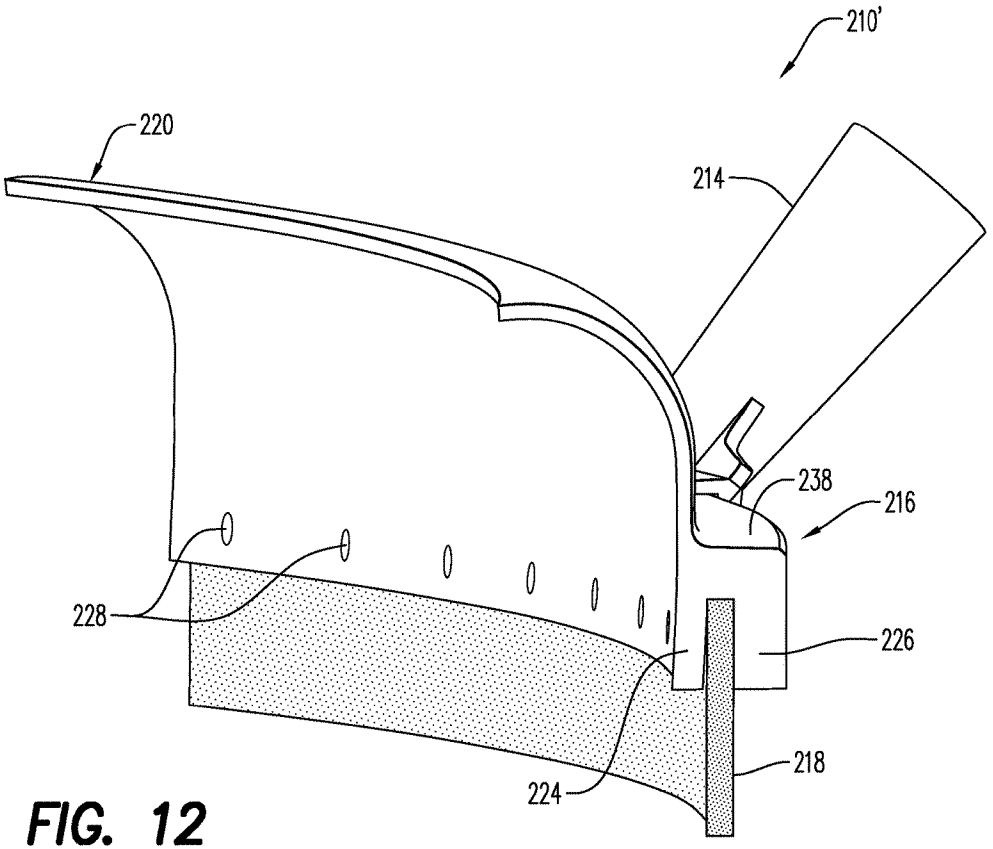
FIG. 12 is a magnified front perspective view of another alternate embodiment of a squeegee device according to the present disclosure.
Figure 13:
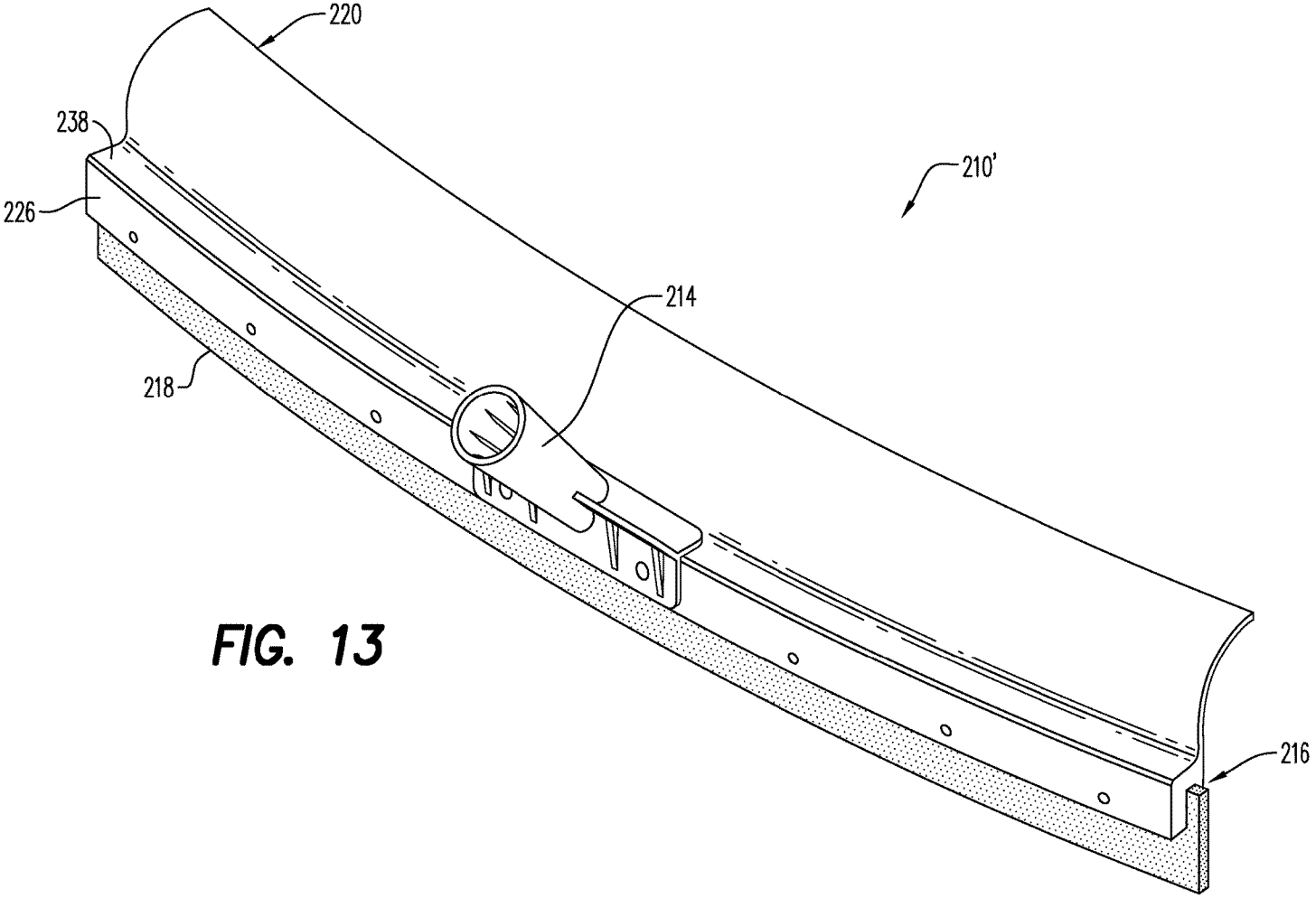
FIG. 13 is a magnified rear perspective view of the device of FIG. 12.

Generally, device 210 shown in FIGS. 10-11 is substantially similar to the embodiment of device 10 shown in FIGS. 1-4 in that it lacks the concave curvature, while device 210' shown in FIGS. 12-13 is substantially similar to the embodiment of device 110, 110' shown in FIGS. 5-9 in that it includes the concave curvature.

Turning now to FIGS. 10-11, device 210 includes blade support 216 with front support 224 and rear support 226.

Device 210—particularly deflector 220 and least one of front and rear supports 224, 226—are formed as a one-piece unit that is drawn or extruded. In the illustrated embodiment, both front and rear supports 224, 226 and bridge 238—are formed as a one-piece drawn or extruded unit with deflector 220. In this manner, device 210 can be easily and inexpensively formed.

Device 210 lacks the plurality of fasteners used in other embodiments to secure blade 218 in support 216. Rather, device 210 includes one or more first retainers 250 formed in front and/or rear supports 224, 226 and, in some embodiments, capture member 252 positioned between blade 218 and support 216. Capture member 252 can be manufactured using any desired method such as, but not limited to, extruding, drawing, molding, casting, and others and can be made from any desired material such as but not limited to plastic, metal, and others.

In the illustrated embodiment, first retainers 250 are illustrated as slots that run in the drawing direction so that the retainers can be formed during the drawing process. Of course, it is contemplated by the present disclosure for first retainers 250 to be ridges or protrusions that run in the drawing or extrusion direction (i.e., along the length of blade support 216 or a combination of slots and ridges.

In embodiments where first retainers 250 are protrusions, the protrusions can be used to secure blade 218 in support by extending into and compressing and/or digging into the blade without the need for capture member 252.

However in the illustrated embodiment, device 210 further includes capture member 252, which includes a plurality of second retainers 254 that correspond in location to first retainers 250. In this manner, blade 218 can be secured in support 216 by compression of capture member 252 between the support and the blade. Additionally, blade 218 can be secured in support 216 by cooperation of first and second retainers 250, 254.

Referring to device 210' shown in FIGS. 12-13, much like device 210, includes deflector 220 and least one of front and rear supports 224, 226 formed as a one-piece drawn or extruded unit.

However, device 210' includes plurality of openings 228 for fasteners (not shown), so that during assembly, blade 218 is placed between front and rear supports 224, 226 and the fasteners are secured in openings 228. Openings 228 and, thus, the fasteners, can pass through blade 218 to further assist in securing the blade in the desired position in support 216. The fasteners can, in some embodiments, also be configured to deform or flex front and rear supports 224, 226 towards one another to maintain blade 218 in the desired position in support 216.

In the illustrated embodiment of device 210', both front and rear supports 224, 226 and bridge 238—are formed as a one-piece drawn or extruded unit with deflector 220. After drawing this workpiece, the one-piece deflector 220, front and rear supports 224, 226, and bridge 238, is subjected to a stamping or other bending operation to provide the concave curvature.

Figure 15:
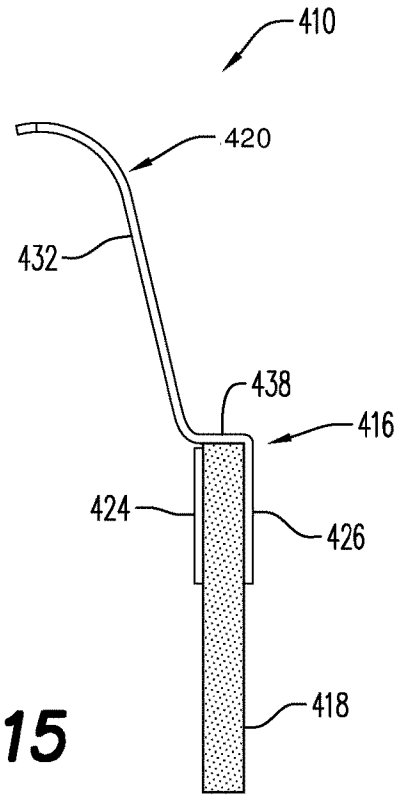
FIG. 15 is a side view of yet another alternate embodiment of a squeegee device according to the present disclosure.
Figure 14:
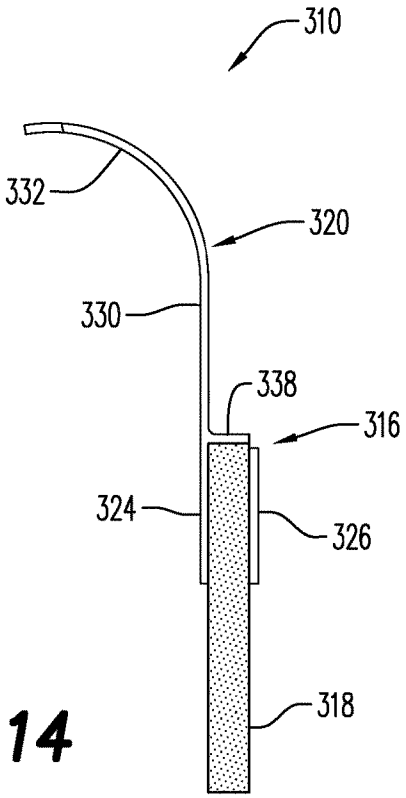
FIG. 14 is a side view of another alternate embodiment of a squeegee device according to the present disclosure.

Referring now to FIGS. 14 and 15, additional exemplary embodiments of a squeegee device is shown and is generally referred to by reference numerals 310 and 410, respectively. Devices 310, 410 are substantially similar to the embodiment of device 10 shown in FIGS. 1-4 in that the lacks the concave curvature. For reasons of brevity and clarity, only the features of devices 310, 410 that differ from that discussed above with respect to device 10 are described herein below.

Device 310 illustrates an embodiment where bridge 338, front support 324, deflector 320 which includes straight portion 330 and curved portion 332—are preferably formed as a one-piece unit. Here, rear support 326 is connected to front support 324 to secure blade 318 in blade support 316. In some embodiments, bridge 338 can be continuous—in embodiments where the one-piece unit is stamped, molded, drawn, cast, or extruded. In other embodiments, bridge 338 can be discontinuous in examples where the one-piece unit is stamped, cast or molded.

Device 410 illustrates an embodiment where deflector 420 which includes only curved portion 432 but lacks the straight portion of the prior embodiments. In this embodiment, curved portion 432 of deflector 420 is formed as a one-piece unit with bridge 438 and rear support 426. Here, front support 424 is connected to rear support 326 to secure blade 418 in blade support 416.

It should be recognized that device 10, 110, 110', 210, 210', 310, 410 is described herein by way of example as either being straight or being curved. However, it is contemplated by the present disclosure for device 10, 110, 110', 210, 210', 310, 410 to be any combination of straight and curved to provide the desired predetermined dimension (D1) so that the tips of the rear support are forward of the central region of the rear support.

It should also be recognized that one or more parts of device 10, 110, 110', 210, 210', 310, 410 are described herein as formed of one-piece by methods such as molding, casting, stamping, rolling, drawing, and extruding. Of course, it is contemplated by the present disclosure for the one-piece to be made by any desired method or connection.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A squeegee device comprising:

a blade support having a front support and a rear support, which are configured to secure a squeegee blade therebetween; and a deflector having a lower portion and an upper portion, which are configured so that the lower portion of the deflector depends upward from the blade support and a leading edge of the upper portion is forward, with respect to a pushing direction, from the blade support, wherein the deflector is configured so that the leading edge is downwardly curved from a horizontal plane that is tangent to an uppermost portion of the deflector.

2. The squeegee device of claim 1, wherein the deflector and the blade support have a concave curve with respect to the pushing direction.

3. The squeegee device of claim 2, wherein the concave curve is constant across a length of the deflector and the blade support.

4. The squeegee device of claim 2, wherein the deflector has a rise-to-run ratio of between 1:6 and 1:24.

5. The squeegee device of claim 1, wherein the upper portion of the deflector is configured as a curved portion that circumscribes between 85 and 115 degrees.

6. The squeegee device of claim 1, wherein the deflector has a ratio of deflector height to blade height of between 2:1 and 1:2.

7. The squeegee device of claim 1, wherein at least one of the front support and the rear support are formed as a one-piece unit with the lower portion of the deflector.

8. The squeegee device of claim 1, wherein the front support is formed as a one-piece unit with the lower portion of the deflector.

9. The squeegee device of claim 8, further comprising a bridge between the rear support and the lower portion of the deflector so that the lower portion is offset, in the pushing direction, from the rear support.

10. The squeegee device of claim 9, wherein the rear support is formed as a one-piece unit with the bridge.

11. The squeegee device of claim 1, further comprising a handle receiver securing a handle to the blade support.

12. The squeegee device of claim 11, further comprising a bridge between the rear support and the lower portion of the deflector so that the lower portion is offset, in the pushing direction, from the rear support, wherein the handle receiver is supported by both the rear support and to the bridge.

13. The squeegee device of claim 1, further comprising the squeegee blade secured in the blade support and, wherein the blade support is extruded and further comprises one or more first retainers formed in the front and/or rear supports configured to secure the blade in the blade support, the one or more first retainers running in an extrusion direction of the blade support.

14. The squeegee device of claim 13, further comprising a capture member between the squeegee blade and the blade support.

15. The squeegee device of claim 14, wherein the capture member comprises a plurality of second retainers that correspond in number and location to the plurality of first retainers.

16. A squeegee device comprising:

a blade support having a front support and a rear support, which are configured to secure a squeegee blade therebetween;

a deflector having a leading edge that depends upward from and forward, with respect to a pushing direction, from the blade support; and a bridge connected to one of the front and rear supports above the squeegee blade, wherein the deflector, the blade support, and the bridge have a concave curve with respect to the pushing direction, the concave curve being constant across a length of the deflector and the blade support.

17. The squeegee device of claim 16, wherein the deflector is configured so that a leading edge of the deflector is parallel to a horizontal plane that is tangent to an uppermost portion of the deflector.

18. The squeegee device of claim 16, wherein at least one of the front support and the rear support are formed as a one-piece unit with the deflector and the bridge.

19. A squeegee device comprising:

a blade support having a front support and a rear support, which are configured to secure a squeegee blade therebetween;

a deflector having a leading edge that depends upward from and forward, with respect to a pushing direction, from the blade support; and a bridge connected to one of the front and rear supports above the squeegee blade, wherein the deflector, the blade support, and the bridge have a concave curve with respect to the pushing direction, the concave curve being constant across a length of the deflector and the blade support, wherein the deflector is configured so that a leading edge of the deflector is downwardly curved from a horizontal plane that is tangent to an uppermost portion of the deflector.

* * * * *